United States Patent [19]

Möhring et al.

[11] Patent Number: 4,816,786

[45] Date of Patent: Mar. 28, 1989

[54] POLARIZER

[75] Inventors: Günter Möhring, Langenhagen; Detlef Block, Hanover, both of Fed. Rep. of Germany

[73] Assignee: Kabelmetal Electro GmbH, Hanover, Fed. Rep. of Germany

[21] Appl. No.: 551,284

[22] Filed: Nov. 14, 1983

[30] Foreign Application Priority Data

Nov. 12, 1982 [DE] Fed. Rep. of Germany ..... 3241889

[51] Int. Cl.[4] ..... H01P 5/16

[52] U.S. Cl. ..... 333/125; 333/137; 333/21 A

[58] Field of Search ..... 333/125, 126, 135, 137, 333/21 A

[56] References Cited

U.S. PATENT DOCUMENTS 2,651,759 9/1953 Lamont et al. ..... 333/137
2,682,610 6/1954 King ..... 333/137 X
3,327,250 6/1967 Sleeper, Jr. ..... 333/125 X
4,420,756 12/1983 Hamada et al. ..... 333/135 X

*Primary Examiner*—Paul Gensler
*Attorney, Agent, or Firm*—Ralf H. Siegemund

[57] ABSTRACT

A polarizer for connection to a first and a second wave guide includes a feed tube and the first wave guide connected laterally to the feed tube whereby a long dimension of the wave guide extends in the direction of the axis of the feed tube. A short circuiting element is disposed in the feed tube between the connection of the first wave guide and one end of the feed tube. The second wave guide extends parallel to the first one and is laterally connected with a wide side to that one end of the feed tube, closing the same. The wide dimensions of the two wave guides are turned by 90°. The second wave guide is short circuited at its end, and a trimming pin is disposed on the second wave guide in axial alignment with the axis of the tube. The other end of the feed tube is connected to a single wave guide. The wave guides may have rectangular or elliptical cross section.

11 Claims, 1 Drawing Sheet

POLARIZER

BACKGROUND OF THE INVENTION

The present invention relates to a polarizer for separating two linearly polarized electromagnetic waves and including a tubular element to which are connected two wave guides having different dimensions in a plane transverse to the direction of wave propagation, and wherein one of the wave guides is connected to the tubular element so that the front end of the former joins laterally the latter.

Polarizers of the type to which the invention pertains are, for example, needed for running differently polarized electromagnetic waves to and/or from directional antennas in radio links or the like. Whereby, for example, one path is provided for transmission purposes, the other one for receiving. Basically it is possible to run the two waves separately, i.e. through two separate wave guide or wave guide systems between the antenna and the transmitter and the receiving circuitry placed elsewhere. If the distance to be bridged in this manner is large (and that is usually the case) a significant expenditure is necessary. For example, the reflector of an antenna may be placed on top of a high tower, being up to a thousand feet high. Therefore, wave guides have to run up the tower because the electric circuitry is, of course, at ground level. Long distances do not only occur in the case of a high antenna mast but in other circumstances. Moreover, the ground station may not necessarily be located right at the mast. It has been suggested to conduct two waves which are vertically or transversely polarized with respect to each other in a single wave guide with round or square-shaped cross section. At one end of the single wave guide, the two waves are combined and at the other end then are separated. For this purpose, one needs a polarizer which permits low reflection feeding and extraction of the waves.

DESCRIPTION OF THE INVENTION

It is an object of the present invention to provide a new and improved polarizer for two electromagnetic waves which are orthogonally polarized with respect to each other. The switch is to be of a simple construction and should permit connection to two wave guides with low reflection feeding without significant expenditure.

In accordance with the preferred embodiment of the present invention it is suggested to provide a polarizer in the form of a feed tube being provided with a connecting flange or the like at one end while a first wave guide or wave guide connecting piece is laterally connected to the feed tube whereby a long dimension of the wave guide extends in the axis of the feed tube. A short-circuiting element is disposed in the feed tube essentially between the connection of the first mentioned wave guide and the other end of the tube. The second wave guide extends parallel to the first one and is laterally connected with one of its wide sides to the other end of the feed tube closing the same at that other end so that the wide or long dimension of the first and second wave guide as far as their cross sections are concerned and at the respective connections are turned by 90°, and the wide or long dimension of the second wave guide extends transversely to the axis of the tube accordingly. The second wave guide is short-circuited at its end, preferably at a distance from the axis of the feed tube being equal to half the wave length equivalent to the center of the transmission band. Moreover, one or more trimming elements are disposed on the second wave guide in axial alignment with the axis of the feed tube.

Such a polarizer is, in fact, constructed in a rather simple fashion and is comprised essentially of a tube with two wave guides connected thereto at a particular orientation. The two wave guides have directions of polarization which are 90° shifted in space and with reference to each other and the connections to the feed tube are commensurate with that orientation. Therefore, the two waves are fed into the feed tube at right angles to each other commensurate with the polarizations and they will remain decoupled without requiring additional components. The second wave guide extends parallel to the first wave guide in the vicinity of the feed tube and, in fact, closes the one end of the feed tube. One doesn't need any particular transition piece but a direct and low reflection connection is, indeed, permitted and made possible. The aforementioned adjusting elements permit the adjustment to the minimum as far as reflection in concerned. Adjustability here may be enhanced by providing a diaphragm between the second wave guide and the feed tube.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
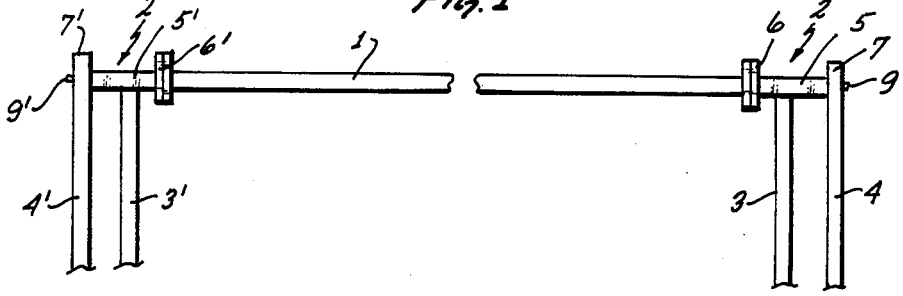
FIG. 1 is a schematic view of a wave guide system with two polarizers constructed in accordance with the preferred embodiment of the present invention for practicing the best mode thereof.

Proceeding now to the detailed description of the drawings, reference numeral 1 refers to an electromagnetic wave guide which may have a round, circular or square-shaped cross section. The wave guide may be provided for connecting an antenna facility with a receiver and transmitter station. For reasons of simplification, the antenna as well as the transmitter and receiver station is not shown, but the connection to one end of a antenna can be provided as disclosed in our copending application Ser. No. 551,287, filed Nov. 14, 1983. It therefore can be assumed, for example, that the wave guide 1 is run up a tower or mast of an antenna. The objective is to conduct two linearly polarized electromagnetic waves in which the directions of polarization are oriented in vertical and horizontal, i.e. in transverse directions with respect to each other.

Figure 2:
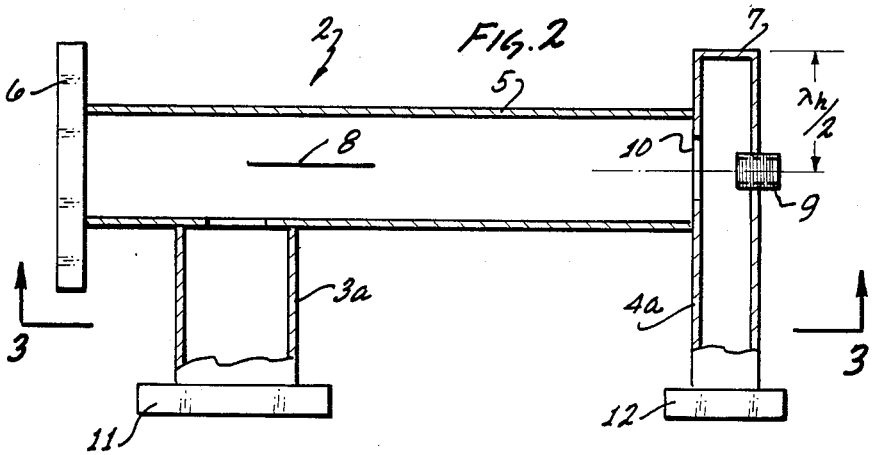
FIG. 2 illustrates one of the polarizers in a cross-sectional view and in an enlarged scale.
Figure 3:
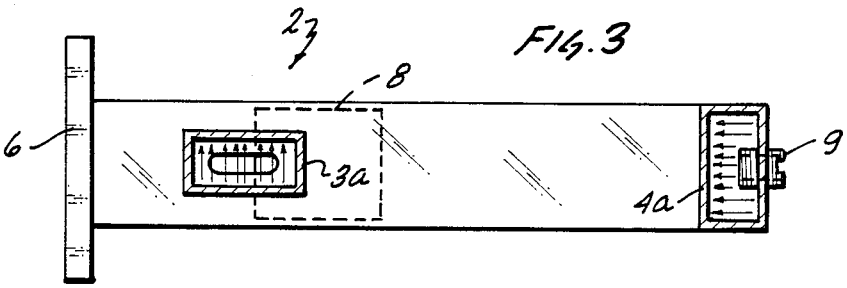
FIG. 3 illustrates the polarizer of FIG. 2 in an elevational view and as seen from the wave guide connections.
Figure 4:
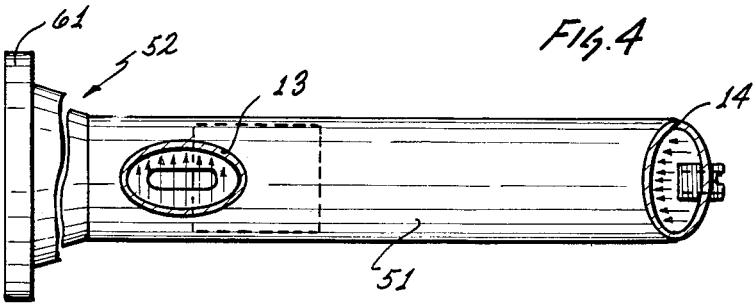
FIG. 4 is a modification as far as wave guide contour is concerned. Otherwise the view is similar to FIG. 3.

The wave guide 1 is provided at each end with a polarizer 2 and 2' respectively. These polarizers are of identical construction and are illustrated in greater detail by way of example in FIGS. 2, 3 and 4. The particular construction shown in FIG. 3 is applicable with preference in the case wave guide 1 is of square shaped cross section, while FIG. 4 is deemed better applicable in the case wave guide 1 is round. Transition pieces may be interposed between the wave guide and the switches, which is optional and needed only if the contour dimensions are different. Such transition is not related to the switching functions themselves.

The wave guide 2 is basically provided for connection to two wave guides 3 and 4 while polarizer 2' is provided for connection to two wave guides 3' and 4'. In view of the similarity of function and practical identity in construction, only one of these types of wave guide needs to be provided. Moreover, it is conceivable that the two differently polarized waves that are being conducted are of different origin, i.e. propagate, in different directions, one stemming from transmission, the other from receiving. In this case, complete symmetry is mandatory.

As far as a polarizer is concerned, it is comprised of a tube or tubular element 5 being of circular or square shaped cross section. One end of the wave guide is provided with a flange 6 for connection to the wave guide 1. The other end is closed through the wave guide 4 or 4' as the case may be, while the guides 3 and 3' are respectively connected laterally to the tubes 5 and 5'. The wave guides as per FIGS. 2 and 3 are presumed to have rectangular cross section having accordingly a long and a short dimension it can readily be seen that the wave guide 3 is connected to the tube 5 such that the long dimension of the rectangle extends in the axis of tube 5 while the long dimension of wave guide 4 extends transversely to the wide dimension of wave guide 3 and is therefore at right angles to the axis of the tube 5. Please note that waveguides 3 and 4 are represented in the figures in some instances merely by portions or connections only, identified by reference numeral 3*a* and 4*a*.

In the case of an elliptical contour of the individual wave guides as shown in FIG. 4, the situation is quite similar except that here the long axis of the respective ellipses are involved and their orientation is at right angles to each other and with reference to the axis in an analogous fashion. The two elliptical wave guides connected to a round tube 51 are denoted 13 and 14 respectively. The geometry of the feed tube, 5 or 51, depends on the cross-section of the wave guide 1 and, not the contour (cross section in terms of geometry) of the individual wave guides such as 3*a*, 3*b*, 13, 14.

Turning to particulars, the wave guide 3 is connected to the tube 5 so that the propagation direction of the waves in the wave guide 3 extends at right angles t the axis of the tube 5 and the plane of connection is parallel to that direction. The wave guide 4 extends parallel to the wave guide 3 and is likewise radial with respect to the axis of feed tube 5. However, the wave guide 4 is connected with its wide side such that the opposite wide side closes off the wave guide 5. A diaphragm 10 is interposed at the axial end proper of tube 5.

It can thus be seen that the wave guide 4 is connected to the feed tube 5 in a matter amounting to a 90° rotation of the physcial configuration as far as the connection of guide 3 is concerned and the wave guide 4 closes off the feed tube 5 completely. A short circuitry element 7 closes the wave guide 4 in the direction of predominant extension, and that closing and short circuitry sheet 7 is spaced from the axis of tube 5 by a distance which is preferably half the waves length with reference to the mean frequency of the transmission band. The spacing is denoted by $\lambda h/2$ in the drawing.

It can thus be seen that the arrangement of the two wave guides 3 and 4 with respect to the tube 5 are such that the two electromagnetic waves are fed into the tube 5 with a 90° rotation between the respective directions of polarization. The arrows in FIG. 3 indicate these directions of polarization. Therefore, the two waves fed into the tube 5 are, in fact, decoupled even right at the point of feeding. The orientation of polarization inside feed tube 5 is the direct result of the orientation of coupling wave guides 3 and 4 (or 3', 4') for the feed tube. Consequently, further decoupling is not necessary within the polarizer, and here particularly in the tube 5.

The polarizer 2 is constructed as such only to have a low reflection and interference free decoupling of the waves as they are fed into the tube 5. For this purpose, a short circuiting element 8 may be provided inside feed tube 5 at a location between the feed point of wave guide 3 and the end of the tube 5 to which the wave guide 4 is connected. This element 8 may be a stationarily secured sheet, or pins can be used instead. This short circuiting element 8 makes sure that the wave entering tube 5 from wave guide 3 will propagate only towards the wave guide 1 which, in this case is represented by the side of tube 5 to which the flange is connected.

FIG. 2 and other show, in addition, that the wave guide 4 is provided with a trimming element 9 which is situated in the extended axis of tube 5 and is preferably adjustable in the direction of this axis. In the illustrated example, the trimming or tuning element 9 is constructed as a threaded pin. The adjustment of the pin 9 permits easy adjustment towards a low reflection feeding of the wave from wave guide 4 into the tube 5. The adjustment is an initial one, and after the reflection minimum has been attained in this manner by turning element 9, the element will be fixed in position so that it cannot accidentally or otherwise change from the adjusted position.

In lieu of the single element 9, one may provide two or more tuning or trimming elements all acting in the extended axis of tube 5. Further tuning elements may be provided inside tube 5 which is known per se and is not illustrated here. The diaphragm 10 is provided for further adjustment and it permits easier trimming by means of the element 9, i.e. a larger frequency range can not be covered by low reflection trimming.

The polarizer 2 is basically provided for the transmission of two differently polarized waves and the transmission is carried out independent from each other. Therefore, it is feasible to provide for transmission in two opposite directions which means that both of the wave guides 3 and 4 can be connected to a receiver, both can be connected to a transmitter or one can be connected to a receiver and one can be connected to a transmitter.

The polarizer 2 can be constructed as a single tube to which the various wave guides 3 and 4 are connected. However, a different mode of manufacturing may be provided for in that certain portions of the wave guide, 3*a* and 4*a* may be directly connected to the switch and are a part thereof. In other words, the configuration shown in FIG. 2 could be of integral, single piece design made, for example, by means of galvanoplastics and therefor capable of very accurate manufacturing. This further enhances low reflection feeding. In this case, then, the integral wave guide elements 3*a* and 4*a* are provided with flanges such as 11 and 12 for connecting to the wave guides proper in strict alignment thereto.

The invention is not limited to the embodiments described above but all changes and modifications thereof not constituting departures from the spirit and scope of the invention are intended to be included.

Another modification that is applicable to round as well as square-shaped feed tubes is shown in FIG. 4. The tube 51 has a flared end 52 ending in a flange 61, to permit connection to a tube 1 that has a larger diameter than the tube 51.

We claim:

1. A polarizer for the separate transmission of two linearly polarized electromagnetic waves and to be connected to a first and a second wave guide for receiving these waves therefrom, comprising:

a feed tube having an axis, the first wave guide being connected laterally to the feed tube whereby a long dimension of the wave guide extends in the direction of the axis of the feed tube and the axis of the first wave guide extends transversely to the axis of the feed tube;

a short-circuiting element disposed in the feed tube essentially between the connection of the first wave guide and one end of the feed tube;

the second wave guide having a cross section which includes a relatively long dimension and an axis extending parallel to the first one and being laterally connected with its side to said one end of the feed tube the long side of the second wave guide and the corresponding width dimension of the tube being identical, said second wave guide closing the feed tube at said end such that the wide dimensions of the first and second wave guides at the region of connection are turned by 90 degrees with respect to each other, the wide dimension of the second wave guide and its axis, both extending transversely to the axis of the tube accordingly;

means for shortcircuiting the second wave guide at its end;

trimming means for reducing reflections and being disposed on the second wave guide in axial alignment with the axis of the tube; and the other end of the feed tube provided for connection to a single wave guide.

2. Polarizer as in claim 1, said trimming means provided for adjustment in the direction of the axis of the feed tube.

3. Polarizer as in claim 1, and including a diaphragm at said one end of the feed tube.

4. Polarizer as in claim 1, said first and second wave guide including short wave guide pieces directly connected to or integral with said feed tube and being provided with connecting flanges for continuing connection to additional wave guide means.

5. Polarizer as in claim 4, and being of single piece construction.

6. Polarizer as in claim 1, wherein said means for shortcircuiting the second wave guide is spaced from the axis of the feed tube by a distance equal to half of the wave length corresponding to the mean frequency band to be transmtted.

7. Polarizer as in claim 1, said first and second wave guide being of rectangular cross section.

8. Polarizer as in claim 1, said first and second wave guide being of elliptical cross section.

9. Polarizer as in claim 1, said feed tube being circularly round.

10. Polarizer as in claim 1, said feed tube having square-shaped cross section.

11. A wave guide system including a particular long wave guide, there being polarizers connected to each end, the polarizers constructed as set forth in claim 1.

* * * * *